United States Patent [19]

Ehrenrich

[11] 4,363,425

[45] Dec. 14, 1982

[54] FUNNEL FOR DIESEL OIL CANS

[76] Inventor: Burt J. Ehrenrich, 110 S. 129th East Ave., Tulsa, Okla. 74128

[21] Appl. No.: 120,716

[22] Filed: Feb. 11, 1980

[51] Int. Cl.[3] ..... B65B 7/28

[52] U.S. Cl. ..... 222/85; 222/527

[58] Field of Search ..... 222/83.5, 85, 86, 460, 222/465, 527

[56] References Cited

U.S. PATENT DOCUMENTS

| | | | |
|---|---|---|---|
| 1,619,708 | 3/1927 | Dietrick . | |
| 1,952,840 | 3/1934 | Claus et al. | 222/85 |
| 2,002,610 | 5/1935 | Nall . | |
| 2,024,898 | 12/1935 | Weltner | 222/83.5 |
| 2,026,588 | 1/1936 | Nall . | |
| 2,029,334 | 2/1936 | Nall . | |
| 2,038,775 | 4/1936 | Weber | 222/86 X |
| 2,374,384 | 4/1945 | Sansom | 222/85 X |
| 2,746,645 | 5/1956 | Knabel . | |
| 2,751,121 | 6/1956 | Stober | 222/85 |
| 2,757,829 | 8/1956 | Ahlquist | 222/527 |
| 3,052,375 | 9/1962 | Kyser | 222/85 X |

*Primary Examiner*—David A. Scherbel

*Attorney, Agent, or Firm*—Head, Johnson & Stevenson

[57] ABSTRACT

An apparatus for opening a fluid-filled container and pouring the fluid therefrom being comprised of a circular member with an inner and outer surface with an elongated rim therearound, the circular member being placed over the fluid container; a plurality of container-piercing blades disposed on the inner surface of the member; an opening through the circular member cooperable with one of the container-piercing blade; and a flexible tubular funnel attached at one end thereof around the opening, the funnel being of sufficient rigidity to not bend under the weight of the apparatus and the fluid-filled container thereby supporting the apparatus and the container at any desired angle while fluid is being poured therefrom.

1 Claim, 4 Drawing Figures

FUNNEL FOR DIESEL OIL CANS

BACKGROUND OF THE INVENTION

1. Field of the Invention

The present invention relates to a funnel apparatus for pouring a fluid from a container and, more particularly, to such an apparatus which is provided with a flexible funnel which is of sufficient rigidity to support the weight of the apparatus and the fluid-filled container at any desired angle while fluid is being poured therefrom.

2. Description of the Prior Art

There are a number of container or can opening devices in use today, many with funnels attached thereto. These devices generally have a tubular enclosure with a plurality of can piercing protrusions on the inner surface of the enclosure which when placed over the top of a can will open a pouring hole and a breathing hole for the passage of fluid from the container. A flexible funnel is attached to the tubular enclosure around the pouring hole as shown in U.S. Pat. No. 1,619,708 to Dietrick and U.S. Pat. No. 2,746,645 to Kanabel. None of these prior art devices can efficiently be used to fill the crankcase opening of a diesel engined truck due to the location of the opening which is usually reached with great difficulty. Oil for these diesel trucks usually comes in one gallon containers which require the mechanic to open the can and then manually pour the oil into the engine's crankcase which is fatiguing to the mechanic. There appears to be no can opening device with a flexible funnel which can open a diesel oil can and at the same time have a flexible funnel which is of sufficient rigidity to support the device and a one gallon oil can in any desired angle when the mouth of the funnel is placed within the crankcase of the engine so as to allow the mechanic to perform other duties.

SUMMARY OF THE INVENTION

The present invention provides a funnel apparatus for pouring a fluid from a container and, more particularly, to such an apparatus which is provided with a flexible funnel that is of sufficiently rigidity to support the weight of the apparatus and the fluid-filled container, thereby supporting the apparatus and the container at any desired angle while fluid is being poured therefrom. The present invention further provides a container opening apparatus which is adapted to open large oil cans, such as one gallon oil cans used to fill diesel engined trucks.

The apparatus is comprised of a circular member having an inner and outer surface and with an elongated rim therearound. A plurality of container opening devices, such as small triangular piercing metal blades are attached on the inner surface of the member. An opening is provided through the circular member adjacent and cooperable with one of the container opening devices. A flexible tubular funnel attached at one end thereof around the opening and the circular member. The funnel is of sufficient rigidity to not bend under the weight of the apparatus and a fluid-filled container such as a one gallon oil can. The apparatus is placed over the top of the oil can and is pressed downward thereon to pierce the top surface of the container, then the apparatus is tilted so that the funnel may be placed within the crankcase opening of a vehicle and for the fluid to flow there into. The funnel is such that is fully supports the apparatus and the fluid-filled container at any desired angle while fluid is being poured therefrom.

DETAILED DESCRIPTION OF THE PREFERRED EMBODIMENTS

Figure 1:
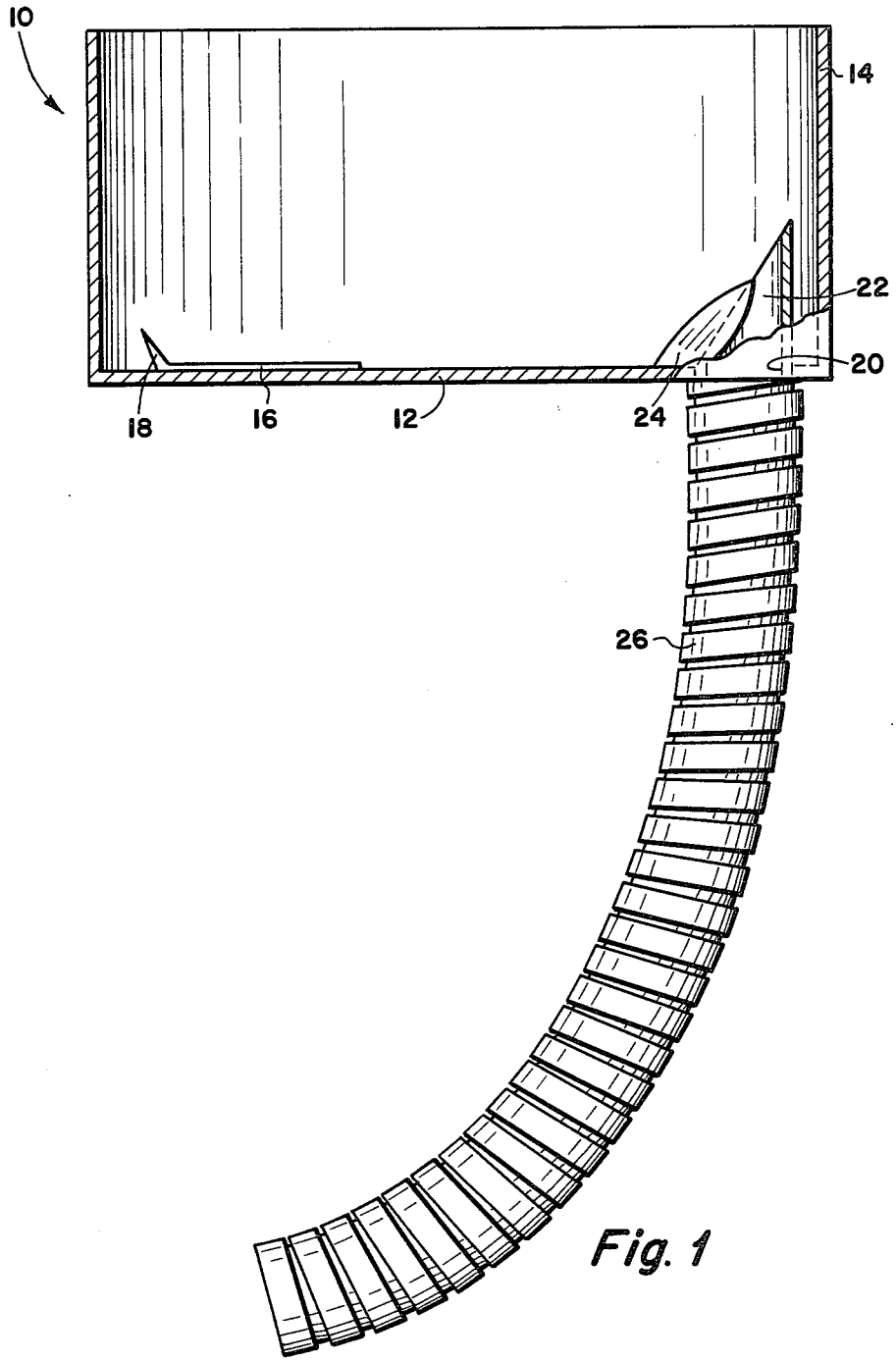
FIG. 1 is a sectional view of an apparatus for opening a fluid-filled container embodying the present invention.
Figure 2:
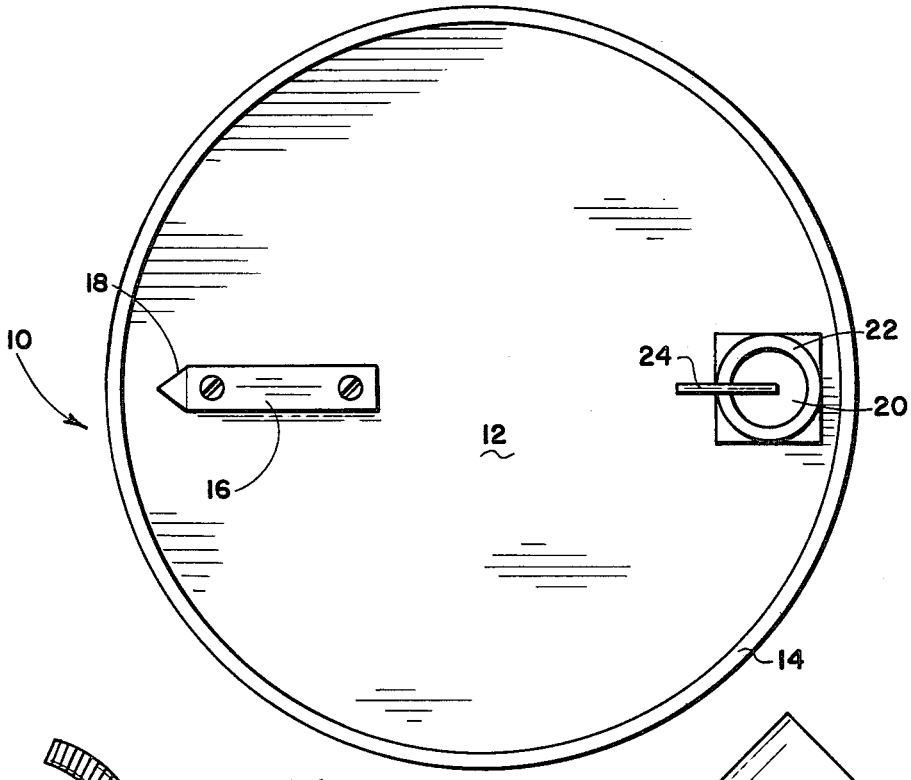
FIG. 2 is a view taken along line 2—2 of FIG. 1.

Referring to the drawings in detail, reference character 10 generally indicates an apparatus for opening a fluid-filled container and pouring the fluid therefrom. As shown in FIGS. 1 and 2, the apparatus 10 is comprised of a circular member 12 having an inner and outer surface and is provided with an elongated rim 14 therearound which extends from the inner surface of the member 12. A rectangular piece of metal 16 is attached to the inner surface of the circular member 12 and is provided with a raised triangular lip or piercing blade 18. An opening 20 is provided in the circular member 12, adjacent the rim 14, and is oppositely spaced from the triangular member 16. A curved and bevelled blade 22 is attached to the inner surface of the circular member 12 around the opening 20. A straight blade 24 is attached to the inner surface of the member 12 and partially extends across the opening 20. The blades 18, 22 and 24 are replaceable.

A flexible tubular funnel or spout 26 is attached to the exterior surface of the circular member 12 and around the opening 20. The funnel 26 is constructed of metal and requires six to seven pounds of pressure in order to bend.

Figure 3:
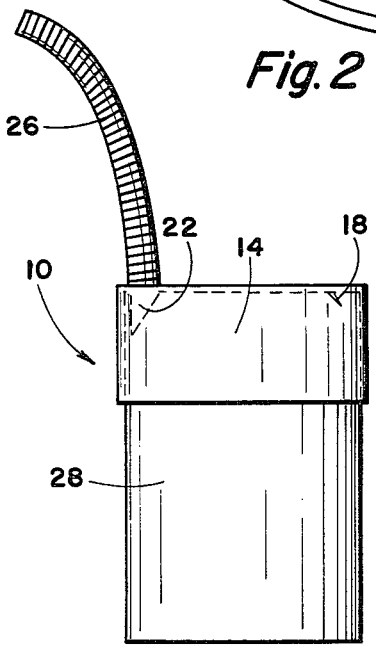
FIG. 3 is a side elevational view of the apparatus placed over the container.

As shown in FIG. 3, the apparatus 10 is placed over the top of a fluid container 28, such as a one gallon capacity oil can. When the apparatus 10 is pressed downward onto the top surface of the oil can 28, the blade 18 opens a breathing hole in the can 28 and the blades 22 and 24 open and peel back metal from the top surface of the container 28 so as to open a hole for the pouring of fluid from the oil can 28.

Figure 4:
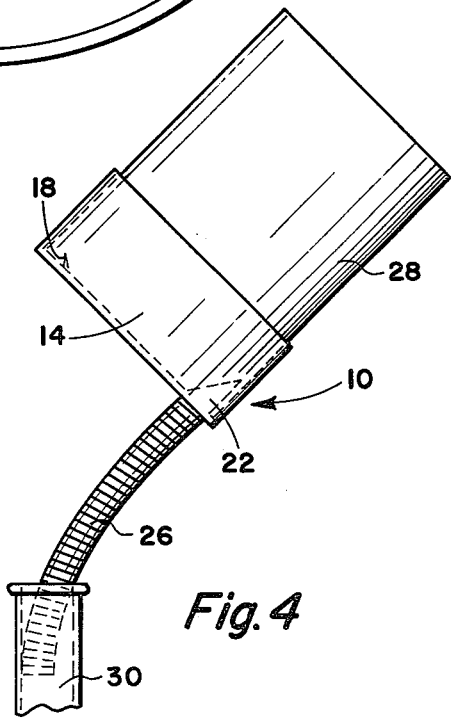
FIG. 4 is a side elevational view with the funnel of the apparatus placed within the crankcase opening of an engine.

In order to fill the crankcase 30 of an engine, as shown in FIG. 4, the apparatus 10 with the oil can 28 attached thereto is tilted upwards and the funnel 26 is inserted into the crankcase 30. The funnel 26 is of sufficient rigidity so as to fully support the weight of the apparatus 10 with the fluid-filled oil can 28 at any desired angle while fluid is being poured therefrom. As can be seen, the angle or curvature of the funnel 26 may be changed so that the apparatus 10 may be placed in any desired position within the cramped confines of an engine compartment.

Whereas the present invention has been described in particular relation to the drawings attached hereto, it should be understood that other and further modifications of the invention, apart from those shown or suggested herein, may be made within the scope and spirit of this invention.

What is claimed is:

1. An apparatus for opening a fluid-filled cylindrical container of one gallon size or larger and pouring said fluid therefrom being comprised of:

a circular cylindrical member slightly larger than said container, said member closed at one end to define an inner surface to be placed over said fluid-filled container;

A container opening means disposed on said inner surface of the end of said member;

an opening through said end cooperable with said container opening means;

a flexible tubular funnel attached to said end thereof around said opening, said funnel being of sufficient flexibility to be positioned by hand pressure yet of sufficient rigidity to not bend under the weight of said apparatus and said fluid-filled container thereby supporting said apparatus and said container at any desired angle while fluid is being poured therefrom and a piercing means opposite said container opening means.

* * * * *